United States Patent [19]

Gutzwiller

[11] 4,130,278

[45] Dec. 19, 1978

[54] RACQUET STRINGING MACHINE

[76] Inventor: Robert L. Gutzwiller, 730 Barr Crest Ln., Lancaster, Pa. 17603

[21] Appl. No.: 808,538

[22] Filed: Jun. 21, 1977

[51] Int. Cl.[2] ..... A63B 51/14

[52] U.S. Cl. ..... 273/73 A

[58] Field of Search ..... 273/73 A; 73/145

[56] References Cited

U.S. PATENT DOCUMENTS

| | | | |
|---|---|---|---|
| 2,069,736 | 2/1937 | Roberts | 273/73 A |
| 2,100,948 | 11/1937 | Doll | 273/73 A |
| 2,146,853 | 2/1939 | Ryckman | 273/73 A |
| 2,154,870 | 4/1939 | Serrano | 273/73 A |
| 2,309,849 | 2/1943 | Kausal et al. | 273/73 A |
| 2,971,760 | 2/1961 | Boykin et al. | 273/73 A |
| 3,302,950 | 2/1967 | Hartman | 273/73 A |
| 3,511,502 | 5/1970 | Spenle | 273/73 A |

FOREIGN PATENT DOCUMENTS

| | | | |
|---|---|---|---|
| 25404 | 11/1935 | Australia | 273/73 A |
| 744743 | 1/1944 | Fed. Rep. of Germany | 273/73 A |

*Primary Examiner*—Richard J. Apley

*Attorney, Agent, or Firm*—James J. Kennedy

[57] ABSTRACT

A racquet stringing machine having automatically activated locking means and an improved tension means using a free hanging weight to apply a uniform tension to a racquet string through a wheel and drum which are connected to the weight and the racquet string, respectively.

17 Claims, 13 Drawing Figures

16
66
67
20
68A
68
71
74
70
10
64
68B
82
72
76
48
6
78
6
84
46
56

20
66
68A
10
74
68
70
64
82
80
68B
76
46
48

66
68A
10
74
68
71
70
64
72
77
62
56
84
78
48
46

76
78
68
80
82

RACQUET STRINGING MACHINE

BACKGROUND OF THE INVENTION

This invention relates to apparatus for use in the stringing of tennis or other racquets.

There are numerous racquet stringing devices that have, over the years, been commercialized or otherwise described in the patented arts. Many of these known devices employ complicated means to fasten new strings in the tension applying device, while others employ complicated tension applying apparatus made up of hand or foot activated levers or screw devices and weights. The stringing devices are neither portable in the sense they could easily be used at home, nor are they of simple enough construction to permit the relatively untrained to use them effectively. The improved stringing machine, to be more fully described hereinafter, is relatively simple in design, completely portable and has the distinct advantage in that it can uniformly apply the desired tension to a racquet string throughout the entire restringing process.

With the available stringing devices the amount of tension is often not uniformly applied during the entire stringing operation. The resultant tension on the strings of a restrung racquet will often be less than the tension originally sought to be applied. These differences of tension result from several factors. First, the new string itself may not have been rigidly clamped by the stringer and through slippage causes a resultant loss of tension in that string. Secondly, many clamps in available stringing devices are not secured themselves so that they flex or move relative to their initial settings, again causing the loss of tension. Similarly, measurement of the tension in the cross strings may indicate a difference of 10 or more pounds of tension compared to the tension of the long strings. This difference can be attributed to the friction encountered in pulling these cross strings through the long strings and to the flexing of the long strings.

The improved racquet stringing machine, to be described hereinafter, will reduce these differences in tension between the long and cross strings by means of its unique design. While these still will be measurable differences in tension between the strings, these differences will be minimal; a marked improvement over existing machines.

There are other differences between the available racquet stringing devices and the instant invention. Consider that two identical racquets strung on the same stringing device even by the same operator will often have noticeable variations in the resultant tension applied to the strings of the two racquets. The improved racquet stringing device described hereinafter is designed to reduce these kinds of variations, too. In the improvable event that slippage should occur in the tensioning clamp, the tensioning drum used in the instant device would automatically rotate to maintain the desired tension. The holding clamp is not likely to move, because the clamp is fixed relative to the stringer frame close to the racquet after a string is clamped.

It is therefore an object of the present invention to provide an improved tension applying apparatus which will, with the use of a constant weight source, apply generally the same tension to a string even though the tension is released and reapplied periodically as a normal procedure in the restring operation.

It is a further object of the invention to provide a machine which is simple to operate and relatively portable.

Another object of the invention is to provide a racquet stringing machine which can be adapted to accept racquets of all sizes, be they wood or metal, large or small.

These and other objects of the invention will become more readily apparent from the drawings, the description of the invention and the appended claims.

DESCRIPTION OF THE PREFERRED EMBODIMENT

Figure 1:
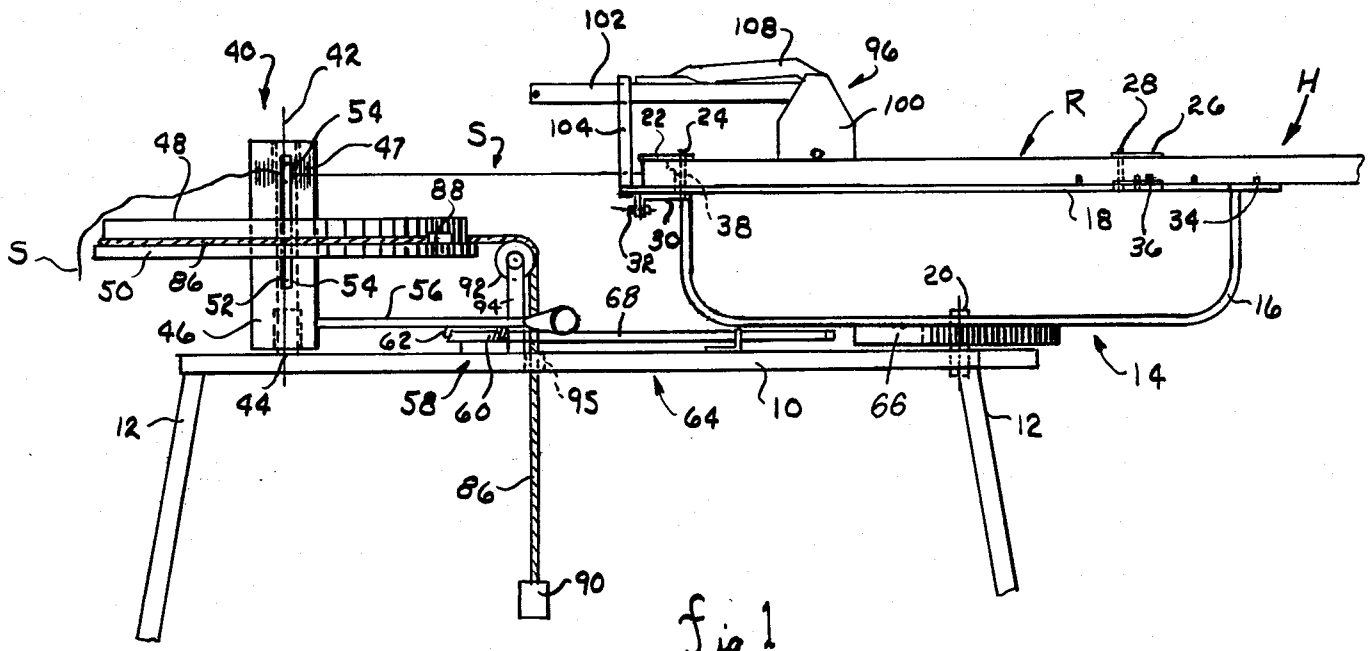
FIG. 1 is a side view of the racquet tensioning machine showing a racquet being held in place on the frame.

The machine may be described by referring generally to the drawings. As particularly shown in FIG. 1, a table or base 10 is provided with a plurality of legs 12, which depend therefrom and which, depending on the desired length, enables the base 10 to be supported horizontally above the floor at a convenient work height. A racquet frame, generally described by numeral 14, is comprised of a U-shaped base member 16 and a rectangular frame 18 having an open interior area (see FIG. 2). The frame 18 is fixed to base 16 by welding or other suitable means so that the base 16 and frame 18 form a rigid structure. A cross member 19 extends from side to side across the open rectangular space formed by the frame 18. The cross member 19 may be moved along the frame to form an adjustable rest for a racquet as will be more fully explained hereinafter. The cross member 19 is held in its desired place relative to the frame by means of a plurality of aligned holes 19A in frame 18 and pins 19B which extend through cross member 19 into holes 19A.

The entire racquet frame 14 is pivotally connected to base 10 by means of pivot bolt 20.

A racquet generally described by the letter R is fastened to the frame 18 by means of a racquet retainer 22 which is placed over the racquet R and fixed in place by bolt 24 which threads into an adjustable mounting angle 30 disposed below the frame 18. Cross member 19 is provided with a center mounted hole which will threadably accept a bolt 28 which extends through a second retainer 26 into a tab 34.

Figure 2:
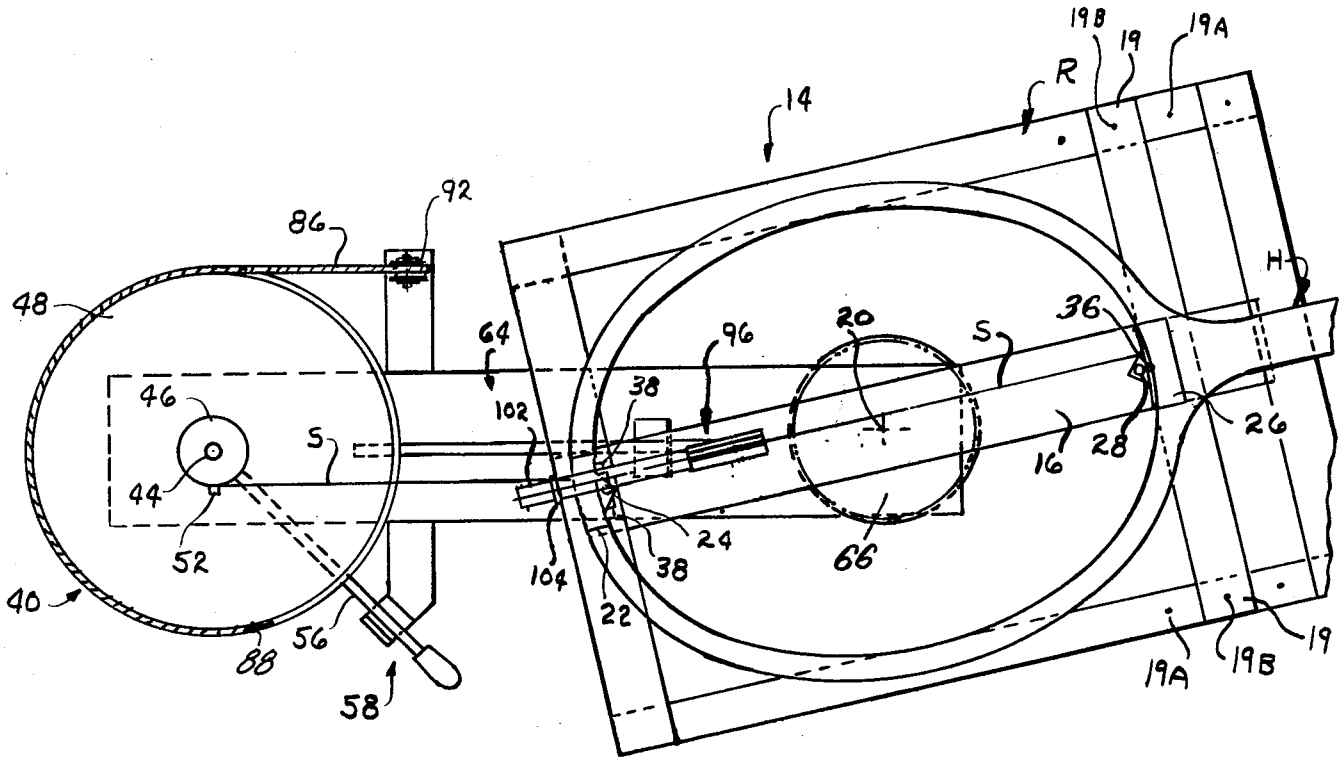
FIG. 2 is a plan view of the racquet tensioning machine showing the relationship of a partially strung racquet to the tension applying apparatus.

Racquet R is located on frame 18 and cross member 19 with its handle H extending outwardly (as shown in FIGS. 1 and 2) so that the interior surface of the racquet at the throat is in contact with oppositely disposed, spaced apart stub 36 on cross member 19 and the head is in contact with pins 38 on frame 18. The racquet retainers 22 and 26 are then placed on the upper surface of the head again at the head and throat of racquet R, so that bolts 24 and 28 may be inserted through the holes in the adjustable mounting angle 30 and cross member 19. The adjustable mounting angle 30, movable with respect to frame 18, is retained in the horizontal plane by bolt 32 and a groove or notch formed in frame 18. The pins 38 extend upwardly from angle 30. By drawing up upon or loosening the bolt 32, the mounting angle 30 can be adjusted inwardly or outwardly to allow for racquet heads of varying sizes and/or shapes. The stubs 36 are fixed relative to the cross member 19.

The string tension applying means is shown generally in FIG. 1 by the numeral 40. The tensioning means is comprised of a vertically disposed axis of rotation 42, a center mounted shaft bolt 44 which extends through base 10 and is fixed in relation thereto, a vertically disposed drum 46 rotatable connected to shaft 44 by means of suitable bearings or bushings (not shown), a horizontally disposed wheel 48 connected to drum 46 for rotation therewith, a clamping device 52 movably connected to drum 46, handle 56 fixed by one end to drum 46 and extending horizontally outward therefrom, fastening means 58 for locking the drum and wheel relative to the base 10, rope or cable 86 fixed to wheel 48 and a free hanging weight means 90.

Figures 3, 4, 5, 6:
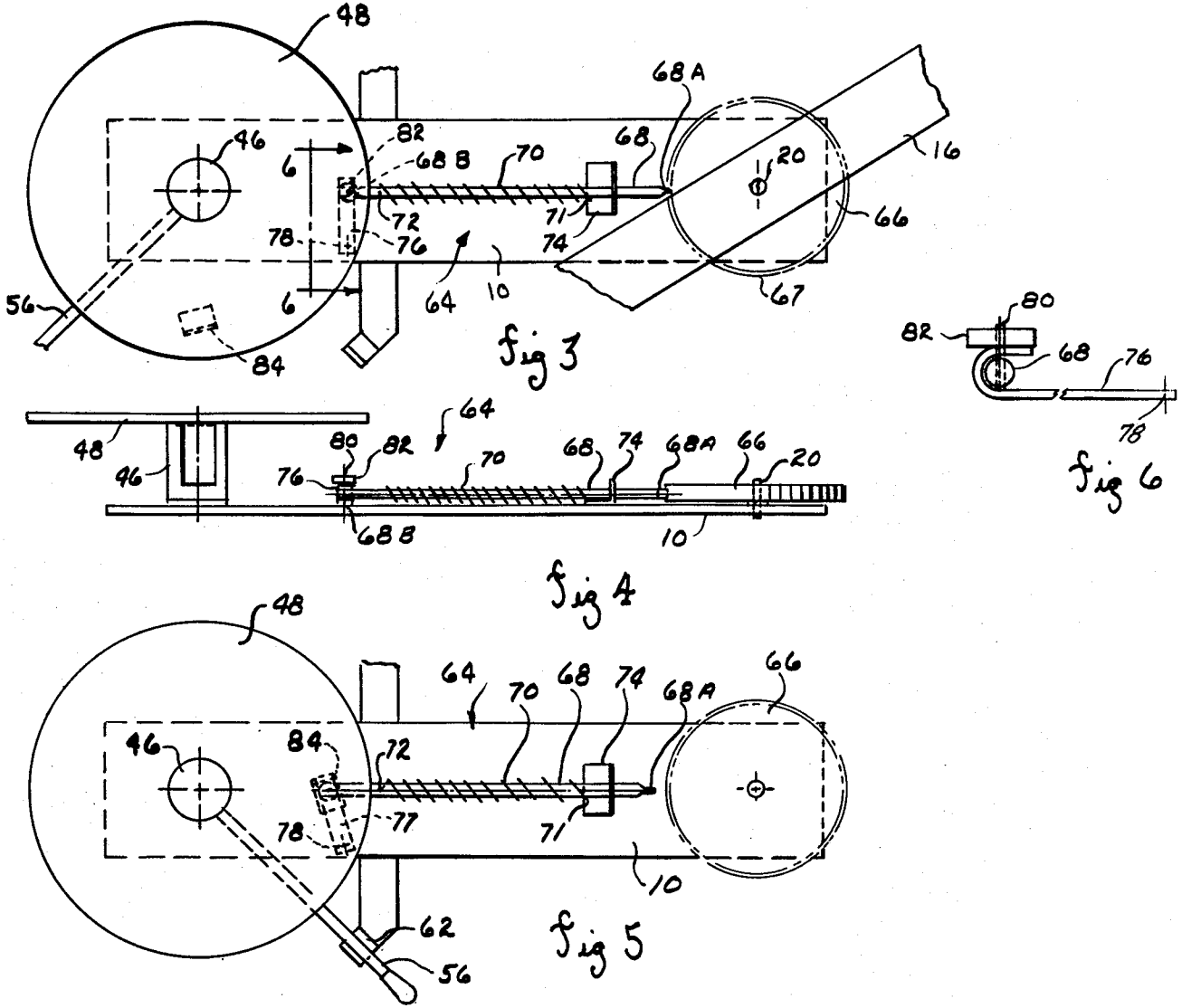
FIG. 3 is a plan view of the brake device used to hold the racquet frame in a fixed position.
FIG. 4 is a side view of the brake device shown in FIG. 3.
FIG. 5 is a plan view of the brake device showing the retractable rod in its unlocked position to permit the racquet frame to rotate freely.
FIG. 6 is a detail view of the J-bracket which actuates the retractable rod.
Figure 9:
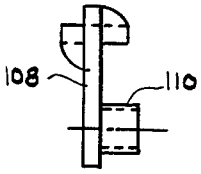
FIG. 9 is an end view of the lever shown in FIG. 7.
Figure 8:
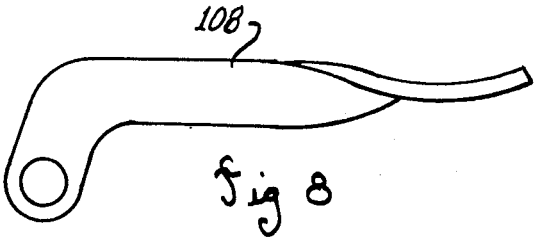
FIG. 8 is a detailed side view of the lever which actuates the clamping jaws.

A locking device, more particularly identified in FIGS. 3–5 by numeral 64, is comprised of a wheel 66, having a plurality of teeth 67 about its periphery, and a longitudinally disposed, retractable rod 68 having an end 68A adapted to engage the teeth 67 of wheel 66. Since the wheel 66 is spaced between table 10 and frame 14, pivotally connected to table 10 about the same vertical axis at pivot 20 as the racquet holding frame 14 and since the U-shaped base 16 is fixed to the upper surface of wheel 66, when the rod 68 is in engagement with teeth 67, the wheel 66 and holding frame 14 are locked in a fixed position relative to table or base 10.

The rod 68 is held in place by spring 70. One end 71 of the spring 70 is fixed to a guide bracket 74. The opposite end 72 of spring 70 is fixed to rod 68. In this way, the rod 68 is continuously urged into engagement with the teeth of the wheel 66 to keep the wheel from turning, except when the rod is retracted.

The rod 68 is connected by its opposite end to a J-bracket 75, as shown in FIGS. 3–6. The J-bracket 76 is connected to base 10 by pivot 78. A vertical pin 80 extends through the "J" end of the bracket 76 and through rod 68. A bearing 82 is rotatably disposed on rod 80, as shown in FIG. 6. A cam plate 84 is fixed to the underside of wheel 48 of the tension applying means 40. As the wheel 48 is rotated the cam plate 84 is brought into engagement with the bearing 80, as shown in FIG. 5, so that J-bracket 74 turns counterclockwise, drawing the rod 68 against the force of spring 70 out of engagement with teeth 67. In so doing, the wheel 66 and frame 14 are free to rotate in either direction. During normal operation when tension is being applied to a string by the device, the cam plate 84 is out of engagement with bearing 82 so that the rod end 68A is engaging the teeth 67 of wheel 66 to lock it.

Turning again to a description of the tension applying means, the rope or a cable 86 is fixed to the periphery of wheel 48 by means of connector 88. To reduce friction on the tensioning device a pulley 92 is mounted on stand 94 which is fixed to base 10 and extends upwardly therefrom. Below the pulley 92 a hole 95 (best shown in FIG. 1) is provided in the table or base 10 through which the cable or rope 86 passes.

The rope 86 is fixed to the outer periphery of wheel 48 so as to ride about the periphery of wheel 48 on lip 50. The other end follows the periphery of wheel 48, riding on lip 50, over pulley 92 and downwardly through hole 95 to its free end where the free hanging weight means 90 is suitably attached to it. In this way the weight 90 is directly connected to the wheel 48 and drum 46.

A string clamping device is comprised of a bar 52 attached to drum 46 for movement with respect thereto. Fastening pins 54 are located near the top and bottom of the clamping bar 52 as shown in FIG. 1. These pins 54 extend outwardly from the surface of drum 46 and are fixed thereto. Corresponding holes in clamping bar 52 permit the bar to fit over the pins. With suitable retaining means at the outward end of each pin, the bar 52 can slide inwardly toward and outwardly away from the surface of the drum. The upper drum surface 47 is suitably roughened or otherwise provided with a surface having a relatively high coefficient of friction about its periphery. The reason for this provision will be more fully explained hereinafter.

Another string clamping means 96 is provided to hold strings S in place, under tension, on the racquet during the restringing procedure. Referring to FIGS. 7–13, the holding clamp means 96 is comprised of a right hand jaw 98, a left hand jaw 100, a normally horizontally disposed shaft 102 which is fixed at one end to jaw 100, a retaining device 104, having a notched end 106, a lever 108, cam 110, connecting screw 112 and a pin 114.

The jaws 98 and 100 are disposed so as to open and close relative to each other through a pivoting action. Location pins 118 align the two opposing jaws. A strip 116 is disposed between the jaws and may be made of a resilient material such as rubber or the like.

A threaded hole 122 is provided in jaw 98 and a second threaded hole 124 is provided in jaw 100. These holes are adapted to receive connecting screw 112 and the caming device 110, respectively.

In operation, the assembled string clamping means 96 grasps string S between the jaws 98 and 100 at jaw ends 99 and 101, as shown in FIGS. 1 and 2. The connecting screw 112 holds the two jaws together, and also serves as the fulcrum or pivot which allows the jaws to open and close at their outer ends 99 and 101. The resilient strip 116 keeps the teeth of the jaws parallel and also acts as a spring to urge the jaws open as the lever is activated.

Figure 7:
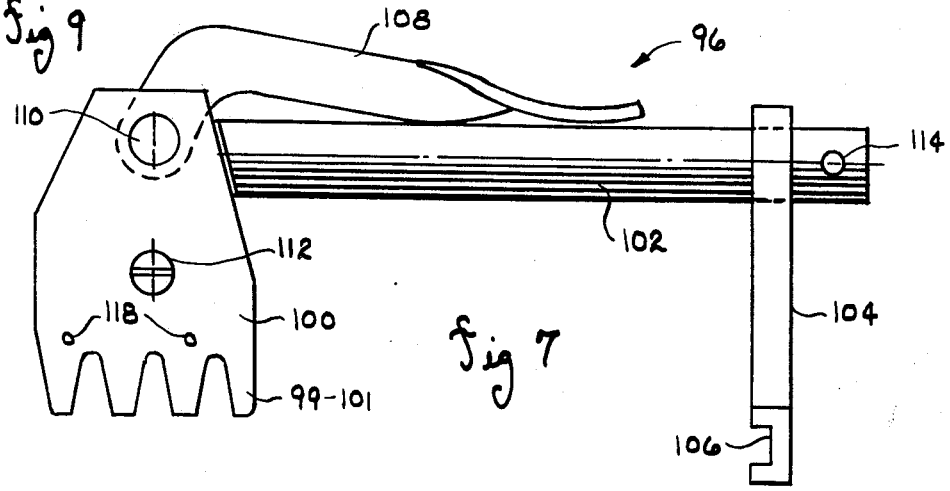
FIG. 7 is a side elevation of the string clamping means.
Figure 11:
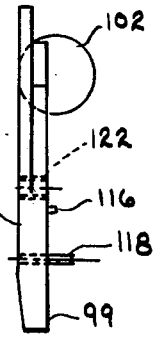
FIG. 11 is an end view of the jaw shown in FIG. 10.
Figure 10:
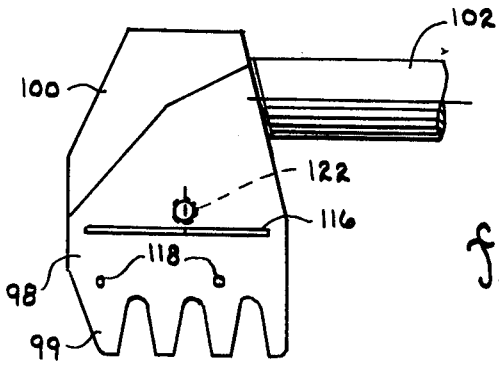
FIG. 10 is a partially broken-away view of the string clamping means showing the left hand jaw.
Figure 13:
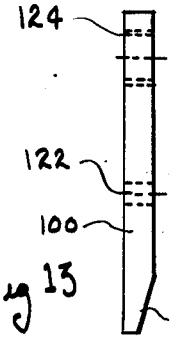
FIG. 13 is an end view of the jaw shown in FIG. 12.
Figure 12:
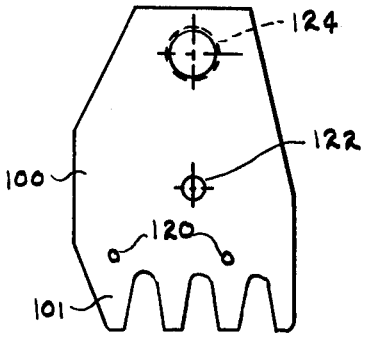
FIG. 12 is a side view of the right hand jaw of clamping means.

The jaw ends 99 and 101 are opened and closed in response to the activation of the cam device 110 by lever 108. The threaded cam 110 screws into or out of the threaded hole 124, forcing the jaws to move apart or together about the pivot screw 112. When the lever 108 is disposed along the shaft 102, as shown in FIG. 7, the device will clamp string S tightly between the jaws. When the lever 108 is lifted to a more vertical position (not shown), the jaws open to allow release of the string.

The retaining device or leg 104 having the notched end 106 is adapted to be slidably positioned along shaft 102 so that the notch 106 will contact the outer edge of frame 18 to hold the clamp means 96 in position with respect to the frame 18 and racquet R during the restringing as shown in FIGS. 1 and 2. The leg 104 has a camming action with respect to shaft 102 as it slides along so that as the ntoch 106 engages frame 18 and the jaws grip a string, the slight cocking action causes the leg 104 to lock on shaft 102 creating a rigid structure. Because the string is firmly gripped close to the racquet edge and further because the clamping device 96 is fixed relative to the frame, little or not tention is lost in the string. The string is held in place without moving relative to the racquet or other strings.

To restring a racquet R, the cross member 19 is first properly positioned along frame 18 by removing the pins 19B, moving the cross member to rest on it and frame 18 and reinserting the pins 19b into the holes 19A. At this time, handle 56 of the tensioning means 40 is in its latched position (see FIG. 1) so that the handle mounted member 62 and fixed member 60 are in engagement. In this position, the locking means is retracted so that the frame 18 is free to rotate in either direction. The rope or cable 86 is wound around the lip 50 of wheel 48 and the weight 90 is in its uppermost position.

The racquet R is positioned so that its handle H is pointing outwardly away from the tensioning means 40, as shown in FIGS. 1 and 2. The racquet is clamped in place on the frame 18 and cross member 19 by means of retainers 22, 26 and bolts 24 and 28, respectively. The adjustable mounting angle 30 can be adjusted in and out with respect to the frame 18 by means of turning bolt 32. This adjustment keeps the interior of the racquet head up snug against stub 36 and pins 38.

After the racquet is clamped at its head and throat, a main string S of suitable length and material (gut, nylon or the like) is fed through the two adjacent holes at the head end opposite the throat, extending in parallel relation toward the two holes closest to the handle at the throat. One of these parallel strings is then temporarily clamped by any suitable string holding clamp device (not shown) to hold this string relative to the racquet head. Next, the frame 18 and racquet R are rotated so that the handle H is adjacent the tensioning means 40. The free end of the long string S is then pulled tight by hand and is fed outside of the second string clamp, bar 52, and around the roughened surface 47 on the upper periphery of drum 46 and then between the drum and the inside of bar 52.

The handle 56 is rotated to free the latching means 58, allowing the wheel 48 and drum 46 to rotate in a clockwise direction, as viewed in FIG. 2, in response to the pull of the weight 90. At this same time as the wheel is rotating clockwise, the cam plate 84 is caused to disengage from bearing 82, allowing the J-bracket 76 to turn clockwise in response to the bias of spring 70 so that the rod 68 engages the wheel 66 between adjacent teeth 67. In this manner the frame is automatically locked in a fixed position. The automatically actuated locking device holds the frame 14 and racquet R in place so that the tensioned string is pulled straight through the hole of a wood or other racquet or straight across the loops of the metal crowns of a metal racquet, thereby reducing the friction and applying a more uniform tension.

As the wheel 48 and drum 46 rotate, the string S is wound on the friction surface of the drum, causing the string to force the bar 52 inwardly toward drum 46 and thereby gripping the string between the bar and the roughened drum surface. The drum is made of a hard material that does not compress as the string is wound on it.

The relationship of the diameter of the wheel 48 to the diameter of the drum 46 is such to establish a 5 to 1 ratio. Therefore, for each pound of free hanging weight, five pounds of tension is applied to string S. Because the ratio of diameters is constant, the same (uniform) tension will always be applied to the string for any given weight. Even though the cable or rope 86 may stretch during the application of tension, the tension applied to the string on the racquet remains the same no matter whether a long or short string is being strung. The downward force of the weight will continue to rotate the wheel and drum until the required tension is applied to the string at which time the rotation will stop. The amount of tension applied can be changed by adding different combinations of weights to the rope.

When the applicable tension is applied to this first long string, string holding clamp 96 is positioned by flipping the over center lever 108, opening the jaws 98–100. By placing the string between the open jaws ends 99–101 and flipping the lever 108 downwardly to the position shown in FIG. 1, the string is clamped. The leg 104 is slid along shaft 102 so that the notch 106 engages the outer edge of frame 18. Thus, this first string is held in place relative to the racquet and the frame 14.

When the holding clamp 96 is positioned, the handle 56 is rotated counterclockwise to release the tension on the string allowing the cable or rope 86 to wind around wheel lip 50. As the handle 56 is moved back to its latched positioned, the frame 14 is automatically unlocked as the cam plate 84, depending from the underside of wheel 48, engages bearing 82, causing the bracket 76 to pivot counterclockwise and retract rod 68 from wheel teeth 67. The free end of the just tensioned string is then unclamped from the drum 46 and bar 52 and then fed back through the next adjacent hole toward the head of the racquet. The frame and racquet are rotated so that the free end of the long string just tensioned is adjacent the tensioning means 40 and the string is wrapped around the drum 46 and bar 52 as before. The tension is applied to this string as before by rotating wheel 48 slowly to allow the weight 90 to apply tension slowly, but uniformly, to the string.

This process of tensioning the long strings is continued until all of the long strings on one half of the racquet are properly strung. The long strings on the second half of the racquet are similarly tensioned after the temporary clamp is first removed. Upon completion of the long string tensioning, the cross strings are similarly strung.

While this invention has been described in connection with two embodiments thereof, it will be understood that either embodiment is capable of modification and that the application is intended to cover any variations, uses or adaptations following, in general, the principles of the invention and including such departures from the present disclosure as come within the known or customary practice in the art to which the invention pertains, and falls within the scope of the invention or the limits of the appended claims.

What I claim is:

1. An improved racquet stringing machine having a base, a racquet supporting frame means pivotally connected to said base, retaining means on said frame for fixing the racquet relative to said frame, first string clamping means adapted to engage said frame and a string under tension to hold the tensioned string relative to the racquet, tension applying means comprised of a wheel rotatably disposed on said base and spaced apart from said frame, a vertically disposed drum on said wheel and rotatable therewith, second string clamping means on said drum for holding a string to be tensioned and a free hanging weight connected by means to said wheel, and locking means disposed between said wheel and said frame and automatically activated by rotation of said wheel for holding said frame in a preselected position while tension is applied to a string by said weight through said wheel and drum.

2. An improved racquet stringing machine as set forth in claim 1, wherein said racquet supporting frame means is comprised of an outer frame portion and a cross member extending across the outer frame portion and adjustably positionable with respect thereto.

3. An improved racquet stringing machine as set forth in claim 1, wherein said drum has an upper surface portion having a relatively high coefficient of friction and said second string clamping means is connected to said drum is proximity to said high friction surface and is adapted to move toward and away from said drum whereby a string to be tensioned is grasped between the drum and said second string clamping means.

4. An improved racquet stringing machine as set forth in claim 1, wherein said locking means is comprised of a toothed wheel pivotally connected to said base between said base and said frame and fixed to said frame, a retractable rod longitudinally disposed along said base and adapted to move into and out of engagement with said toothed wheel and actuating means activated in response to movement of said tension applying means wheel whereby when said rod is in engagement with said toothed wheel said frame is locked in position relative to said base.

5. An improved racquet stringing machine as set forth in claim 4, wherein said actuating means is comprised of a J-bracket pivotally connected by one end to said base, a vertical pin extending through said retractable rod at an end opposite the tooth engaging end and said bracket at the end opposite the pivotal connection, a bearing on said pin and a cam plate mounted on said tension applying means wheel and depending therefrom, said cam plate adapted to engage said bearing causing said bracket to pivot thereby retracting said rod from engagement with said toothed wheel to permit said frame to rotate to another position.

6. An improved racquet stringing machine as set forth in claim 4, wherein said retractable rod is spring biasd into engagement with said toothed wheel.

7. An improved racquet stringing machine as set forth in claim 1, wherein said first string clamping means is comprised of a pair of opposed pivotally connected jaws for gripping a tensioned string there between, a lever actuated cam for opening and closing said jaws, a horizontally disposed shaft connected to one of said jaws and a leg slidably mounted on said shaft, said leg having a notched end for engaging said frame to fix said first string clamping means relative to the racquet and said frame when holding a tensioned string.

8. An improved racquet stringing machine having a base, a racquet supporting frame means pivotally connected to said base, retaining means on said frame for fixing the racquet relative to said frame, first string clamping means for holding a string under tension fixed relative to the racquet and said frame, string tension applying means and locking means disposed between said string tension applying means and said frame means and activated in response to actuation of said string tension applying means to lock said frame means in a fixed position during the tensioning operation, the improvement including string tension applying means comprising:

a wheel rotatably mounted on said base, a drum mounted on said wheel and having an axis of rotation coincident therewith, said drum having an area of high coefficient of friction over a portion of said drum surface, second string clamping means connected to said drum and adapted for movement toward and away therefrom for holding a string to be tensioned between said second clamping means and said drum; and a free hanging weight connected to the outer periphery of said wheel causing said wheel and drum to turn and wind a string to be tensioned around said drum thereby applying uniform tension to each string.

9. An improved stringing machine as set forth in claim 8, wherein the geometric relationship of diameters of said wheel to said drum is 5 to 1.

10. An improved racquet stringing machine as set forth in claim 8, wherein said wheel and said drum rotate about a vertical axis.

11. An improved racquet stringing machine as set forth in claim 8, wherein the racquet string is held by placing the string outside of the second string clamping means around the surface of said drum, between the drum and second string clamping means, forcing said clamping means toward said drum to grip the string between said second string clamping means and said drum.

12. An improved racquet stringing machine as set forth in claim 8, wherein said free hanging weight means is connected to the outer periphery of said wheel by a rope or cable which winds around the wheel as the wheel is moved in one direction and unwinds as the wheel is moved in the opposite direction allowing the weight to apply tension through the wheel and the drum drawing the string tight to a tension equal to a multipal of the weight.

13. An improved racquet stringing machine as set forth in claim 8, wherein said first string clamping means is comprised of a pair of opposed pivotally connected jaws for gripping a tensioned string there between, a lever actuated cam for opening and closing said jaws, a horizontally disposed shaft connected to one of said jaws and a leg slidably mounted on said shaft, said leg having a notched end for engaging said frame to fix said first string clamping means relative to the racquet and said frame when holding a tensioned string.

14. An improved racquet stringing machine as set forth in claim 8, wherein said racquet supporting frame means is comprised of an outer frame portion and a cross member extending across the outer frame portion and adjustably positionable with respect thereto.

15. An improved racquet stringing machine as set forth in claim 8, wherein said locking means is comprised of a toothed wheel pivotally connected to said base between said base and said frame and fixed to said frame, a retractable rod longitudinally disposed along said base and adapted to move into and out of engagement with said toothed wheel and actuating means activated in response to movement of said tension applying means wheel whereby said rod is in engagement with said toothed wheel said frame is locked in position relative to said base.

16. An improved racquet stringing machine as set forth in claim 15, wherein said actuating means is comprised of a J-bracket pivotally connected by one end to said base, a vertical pin extending through said retractable rod at an end opposite the tooth engaging end and said bracket at the end opposite the pivotal connection, a bearing on said pin and a cam plate mounted on said tension applying means wheel and depending therefrom and adapted to engage said bearing causing said bracket to pivot thereby retracting said rod from engagement with said toothed wheel to permit frame to rotate to another position.

17. An improved racquet stringing machine as set forth in claim 16, wherein said retractable rod is spring biased into engagement with said toothed wheel.

* * * * *

UNITED STATES PATENT OFFICE

CERTIFICATE OF CORRECTION

Patent No. 4,130,278 Dated December 19, 1978

Inventor(s) Robert L. Gutzwiller

It is certified that error appears in the above-identified patent and that said Letters Patent are hereby corrected as shown below:

Column 1, line 57, "improvable should read -- improbable --

Column 5, line 8, "ntoch" should read -- notch --.

Column 5, line 19, "196" should read -- 19B --.

Column 7, line 25, "is" should read -- in --.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*